US005592179A

United States Patent [19]

Windyka

[11] Patent Number: 5,592,179

[45] Date of Patent: Jan. 7, 1997

[54] FREQUENCY-HOPPING ARRAY ANTENNA SYSTEM

[75] Inventor: John A. Windyka, Liverpool, N.Y.

[73] Assignee: Martin Marietta Corp., Nashua, N.H.

[21] Appl. No.: 510,731

[22] Filed: Aug. 2, 1995

[51] Int. Cl.[6] ..... H01Q 3/22; H01Q 3/24; H01Q 3/26

[52] U.S. Cl. ..... 342/372; 342/157

[58] Field of Search ..... 342/372, 368, 342/157, 154, 14, 18

[56] References Cited

U.S. PATENT DOCUMENTS 4,045,800 8/1977 Tang et al. .
4,894,660 1/1990 Thomson et al. ..... 342/129
5,206,655 4/1993 Caille et al. ..... 343/700 MS
5,281,974 1/1994 Kuramoto et al. ..... 343/700 MS
5,414,433 5/1995 Chang ..... 342/375

*Primary Examiner*—Theodore M. Blum
*Attorney, Agent, or Firm*—W. H. Meise; D. W. Gomes

[57] ABSTRACT

A phased-array antenna (18) for use with a frequency-hopping transmitter (16) includes a plurality of elemental antennas (210), each associated with a phase-shifter (212) which is controlled (20) to form a beam (216) in the desired direction at a base frequency. The antenna elements (210, 212) are formed into subarrays (**408*t*, 408*b*) each of which is fed from a common port (310). A further phase-shifter (312**) is associated with each subarray, for imposing a phase shift on a group of elements of the overall array. The further phase-shifters are controlled when the frequency of the transmitter is away from the base frequency, to cause a stepwise-continuous correction phase across the array, which maintains the desired beam direction.

2 Claims, 4 Drawing Sheets

FREQUENCY-HOPPING ARRAY ANTENNA SYSTEM

FIELD OF THE INVENTION

This invention relates to antennas, and more particularly to array antennas which are used in systems in which the operating frequency varies rapidly.

BACKGROUND OF THE INVENTION

FIG. 1 is a simplified block diagram of a communication system transmitter, in which a data source 12 is coupled to a frequency-hopping modulator 14, which simultaneously frequency hops at a rapid rate, and modulates the data onto the hopping carrier, as by amplitude or phase modulation, for example. The hopping rate may be equal to the data rate, or it may differ. One possible hopping rate is ten kilohops/second. The modulated carrier is applied over a path 17 to a phased-array antenna 18. Phased-array antenna 18, as known, transmits the signal power into space in one or more beams, under the control of phase-shifter control signals applied thereto over a path 22 from a phase-shifter controller 20.

FIG. 2 is a simplified diagram illustrating a prior-art phased-array antenna which may be used in the system of FIG. 1, as so far described. In FIG. 2, a line array of elemental antennas 210*a*, 210*b*, 210*c*, . . . 210*n* is fed with RF signals from an array of individual controllable phase shifters 212*a*, 212*b*, 212*c*, . . . 212*n*, the phase shifts of which are individually controlled by phase shifter control signals applied over a bus 22. The elemental antenna elements are collectively designated 210, and the phase-shifters are collectively designated 212. Each phase shifter 212*a*, 212*b*, 212*c*, . . . 212*n*, in turn, is fed with RF from a single port or path 17. Those skilled in the art know that the phase shifters of FIG. 2 are controlled to produce a planar wavefront, such as 214, which in turn results in a beam, conventionally illustrated as beam 216, directed in a direction normal to or orthogonal to the planar wavefront 214. The preceding discussion is valid for single-frequency operation, or operation over a narrow band of frequencies. However, when the frequency of operation varies over a significant range, another effect occurs. The phase-shift required to achieve a planar phase front changes with frequency, so that the phase shift at a first or base frequency of operation may be selected to provide the desired planar wavefront direction and resulting beam direction, but will change as the frequency is deviated away from the base frequency. In FIG. 2, the effect of a decrease in frequency, which decreases the required phase-shift imparted by the phase-shifters, is illustrated by a planar wavefront 218, and the change in beam direction is illustrated by beam 220. The offset or "squint" angle due to the frequency change is illustrated as θ. The squint problem can be solved by the use of controllable delays instead of phase shifters in the arrangement of FIG. 2, because the amount of delay does not vary with frequency in an ordinary delay line. However, delay lines, and especially controllable delay lines suitable for high-power applications, tend to be heavy, bulky, and expensive. Consequently, phase shifters are preferred.

It is possible arrange phase control 20 of FIG. 1 to readjust the phase shifters 212*a*–212*n* of the phased-array antenna of FIG. 2 each time the frequency is changed. The calculations required to determine the phase shift required for each phase shifter are not trivial, however, so ultrafast controllers may be required, depending upon the rate of frequency hopping, which controllers are capable of performing the calculations within the time allowed for the frequency hop. As an alternative, a plurality of predetermined phase values can be stored in memory, with the phase control value for each phase shifter at each frequency and each beam angle stored in memory, and accessed for control of the phase shifters. This arrangement is disadvantageous because it requires substantial memory capacity for each phase shifter if a significant number of frequencies and beam directions are to be available. If small memories are used, the number of beam directions and frequencies of operation will likewise be limited.

Improved frequency-hopping phased-array systems are desired.

SUMMARY OF THE INVENTION

An array antenna for use with a frequency-hopping signal includes an array of antenna elements, each for transducing electromagnetic signals between space and a corresponding RF port of the antenna elements. A phase-shifter is coupled to the RF port of each of the antenna elements of the array of antenna elements, for phase-shifting the signals under the control of beam direction control signals. A beam direction control signal generator is coupled to the phase-shifters, for controlling the phase shift of each of the phase-shifters, in a manner selected for forming at least one beam in a selected direction. Either a source or a sink of frequency-hopping RF signals is provided, for generating or receiving the frequency-hopping signals, respectively, and for generating frequency-indicative control signals representative of the instantaneous frequency of the frequency-hopping signals. A coupler coupled to the phase-shifters and to the source or sink, as the case may be, couples the frequency-hopping signals between the phase-shifters and the source or sink, whereby a corresponding one of a transmit and receive beam is generated by the array. Changes in frequency of the frequency-hopping RF signals causes deviations of the antenna beam from the selected direction. The coupler further includes (a) a grouping arrangement coupled to predetermined groups of the phase-shifters, for grouping the phase-shifters and their associated antenna elements into plural subgroups, each including a subgroup feed port, and (b) additional phase shifters coupled to each of the subgroup feed ports, for controllably shifting the phase of the RF signals applied to the antenna elements of each of the subgroups. An antenna beam correction controller is coupled to the additional phase-shifters and to the source or sink, for generating beam direction correction signals in response to the frequency-indicative control signals, for generating a group phase shift of the RF signals which tends to offset the deviations of the beam from the desired direction. In a particular embodiment of the invention, the antenna beam correction controller is coupled to the beam direction control signal generator, for adjusting the amount of group phase shift in response to the phase shift commanded thereby. The hopping frequencies are therefore grouped into sets, and the elemental phase shifters are controlled at one frequency within the set, preferably the center frequency. The correction phase shifters are controlled at each frequency hop.

DESCRIPTION OF THE INVENTION

Figure 2:
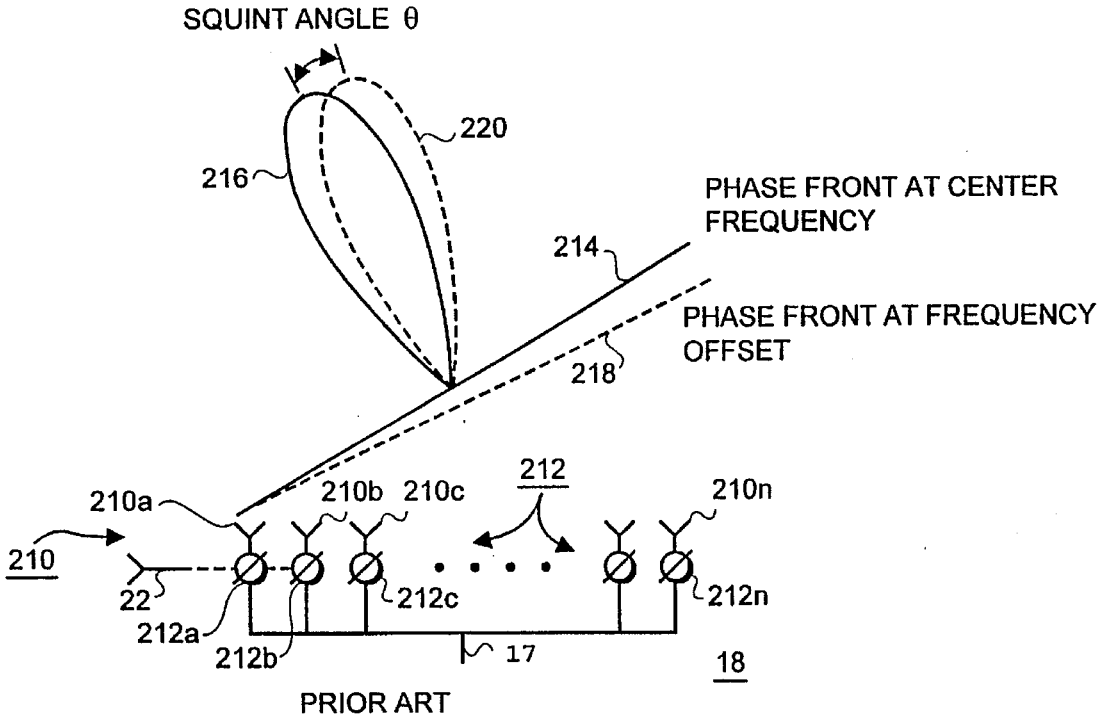
FIG. 2 is a simplified block diagram of a prior-art phased-array antenna which can be used in the arrangement of FIG. 1.

Initially, it should be stated that the words used to describe antennas are subject to several conventions. Antennas are devices which transduce electromagnetic energy between a port and free space. A passive antenna, such as the elemental antennas of FIG. 2, are reciprocal, in that they have the same characteristics, such as impedance at the port, and beam shape, when transmitting signal as when receiving signal. However, as a result of historical accident, the terms used for transmission are, in general, different from the terms used for reception. With present-day understanding of antennas, these terms are now usable interchangeably. More often, the operation of an antenna is couched in terms of either transmission or reception, with the other mode of operation being understood from the context. Thus, the port to which an antenna transduces may be termed a "feed" port, regardless of whether the antenna is operating in a transmitting or a receiving mode. In the context of antenna elements associated with phase-shifters, the feed port may be considered to be the phase-shifter "input" port.

Figure 3:
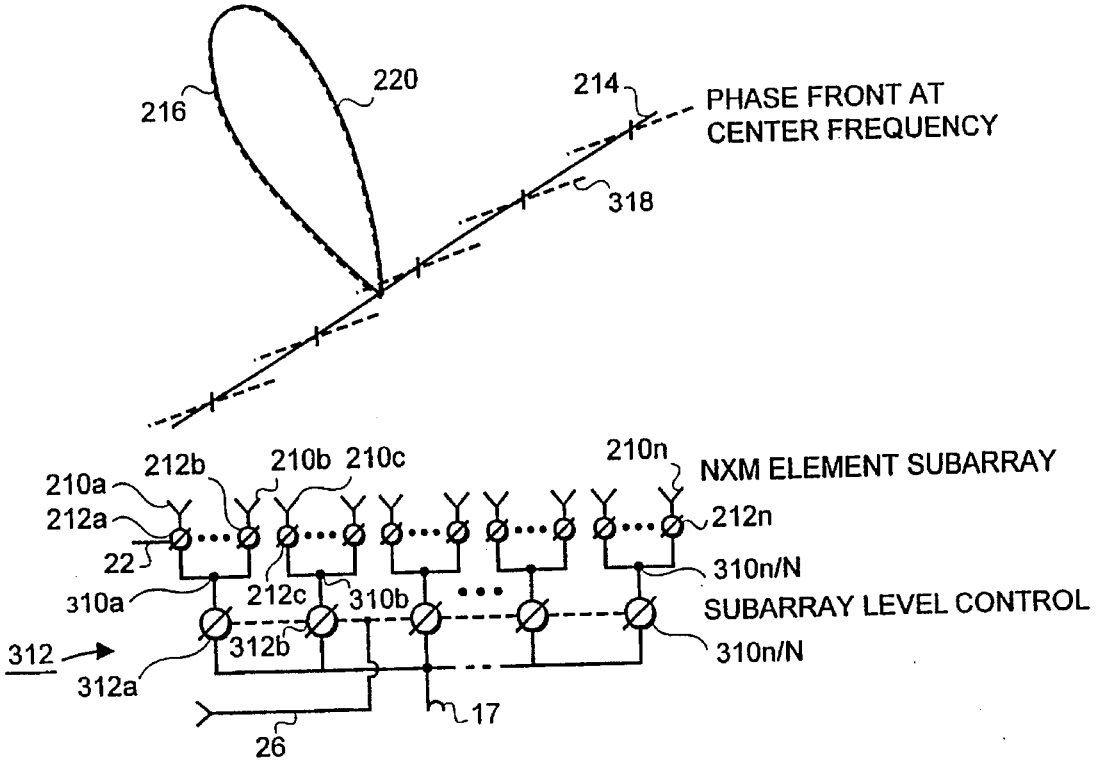
FIG. 3 is a simplified block diagram of an antenna according to the invention, which can be used in the arrangement of FIG. 1 to form a communication system according to the invention.

In FIG. 3, the elemental antennas 210*a*, 210*b*, . . . 210*n*, and their associated phase shifters 212*a*, 212*b*, . . . 212*n*, are grouped into groups of N antenna-element-and-phase-shifter pairs. For example, the N elemental antennas 210*a*, . . ., 210*b* and their associated phase shifters 212*a*, . . . , 212*b* are grouped, so that they are fed in common with RF at a common feed port 310*a*. Similarly, elemental antenna 210*c* and its associated phase shifter 212*c* is part of a subarray group which is fed at a common RF feed port 310*b*. The remaining elements are also grouped into subarrays, which are fed at RF ports which have designation numbers extending through port 310*n*/N.

Each subarray port 310*a*, 310*b*, . . . , 310*n*/M of FIG. 3 is connected to a further phase shifter 312*a*, 312*b*, . . . , 312*n*/M, referred to jointly as 312. Each of the further phase shifters 312*a*, 312*b*, . . . , 312*n*/M in turn is connected for RF signal purposes to common port or path 17. This arrangement allows control of phase shifters 212*a*, 212*b*, . . . 212*n* by means of phase controller 20 of FIG. 1, as in the case of FIG. 2. As mentioned in conjunction with FIG. 2, beam tilt or squint occurs when the frequency of the carrier deviates from the frequency for which phase shifters 210*a*–210*n* are set. According to the invention, the phase shifts for phase shifters 210*a*–210*n* are set at a frequency, and the frequency of the carrier signal is allowed to change by a plurality of frequency steps before the phase shifters 210*a*–210*n* are reset. Instead, a correction phase command is applied at each frequency step (or for a group of frequency steps), from step phase correction block 24 of FIG. 1, by way of a control path 26, to the further phase shifters 312*a*–312*n*/N, to thereby generate a stepped wavefront correction, illustrated as the dash-line wavefront 318 in FIG. 3. This dash-line stepped or piece-wise continuous wavefront 318 approximates, at the changed frequency, the desired wavefront 214, established by the phase shifters 212*a*–212*n*, and generates a beamshape and beam direction 220 which closely approximates the desired beamshape and direction, namely beamshape and direction 216. Plot 216 represents the beamshape and direction commanded by phase controller 20 of FIG. 1 at the original or base frequency.

Figure 4:
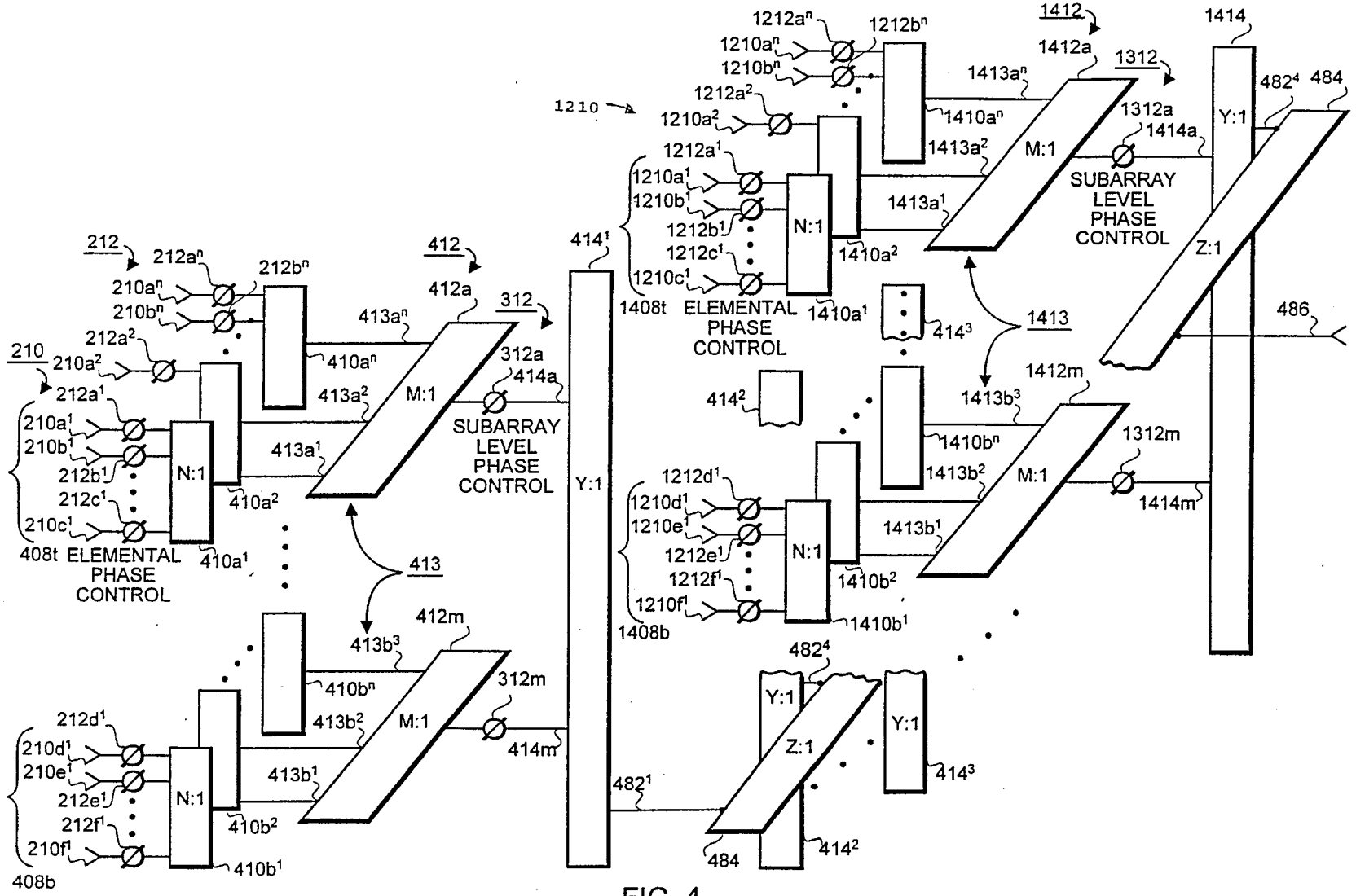
FIG. 4 is a simplified block diagram of a beamformer which can be used in conjunction with an array of antenna elements to produce a phased-array antenna according to the invention.

FIG. 4 is a simplified block diagram of an array antenna according to the invention, illustrating a three-dimensional array, together with its beamformers, arranged for two-tier phase control of the vertical beam position. In FIG. 4, the nearest vertical column of elemental antennas is designated 210, and the elements of the column are broken into vertically disposed subarrays, the uppermost of which is designated 408*t*, and the lowest of which is designated 408*b*. Within the nearest column of elemental antennas 210, the individual elemental antennas are designated with a superscript "1", the next column of elemental antennas is designated by the superscript "2", and the elemental antennas of the last vertical column of elemental antennas of a first subsection of the array is designated with a superscript "n", representing n columns. Thus, the nearest column of antenna elements 210 is designated 210*a*$^1$, 210*b*$^1$, . . . , 210*c*$^1$, . . . 210*d*$^1$, 210*e*$^1$, . . . 210*f*$^1$. The next or second column of antenna elements has its upper element designated 210*a*$^2$, while the two upper elements of the last, n$^{th}$ or most remote vertical column of the nearest subsection, are designated 210*a*$^n$ and 210*b*$^n$. Each elemental antenna element of FIG. 4 is associated with a corresponding beam control phase shifter 212, which are designated in a manner similar to the designations of their associated antenna elements. Thus, antenna elements 210*a*$^1$, 210*b*$^1$, . . . 210*c*$^1$, . . . 210*d*$^1$, 210*e*$^1$, . . . 210*f*$^1$ are associated with corresponding phase shifters 212*a*$^1$, 212*b*$^1$, . . . 212*c*$^1$, . . . 212*d*$^1$, 212*e*$^1$, . . . 212*f*$^1$, respectively. Also, antenna elements 210*a*$^2$, 210*a*$^n$ and 210*b*$^n$ are coupled to their respective phase shifters 212*a*$^2$, 212*a*$^n$ and 212*b*$^n$.

As mentioned, the antenna elements and their associated phase shifters in each vertical column of FIG. 4 are broken into vertically disposed subgroups. The elemental antennas 210*d*$^1$, 210*e*$^1$, . . . 210*f*$^1$, and their associated phase shifters 212*d*$^1$, 212*e*$^1$, . . . , 212*f*$^1$ are fed by 1:N vertical column beamformer 410*b*$^1$. Additional 1:N vertical column beamformers 410*b*$^2$, 410*b*$^n$, and other vertical column beamformers (not illustrated) lying between vertical column beamformers 410*b*$^2$ and 410*b*$^n$ feed other bottom vertical column subgroups (not illustrated).

The vertical column beamformers of each vertically disposed subgroup of FIG. 4, such as subgroups 408*t* and 408*b*, are fed by horizontal beamformers 412. More particularly, each output port 413*a*$^1$, 413*a*$^2$, . . . 413*a*$^n$ of a 1:M horizontal row beamformer 412*a* is coupled to the input port of a corresponding one of vertical column beamformers 410*a*$^1$, 410*a*$^2$, . . . , 410*a*$^n$, each output port 413*b*$^1$, 413*b*$^2$, . . . 413*b*$^n$ of a 1:M horizontal row beamformer 412*m* is coupled to the input port of a corresponding one of vertical column beamformers 410*b*$^1$, 410*b*$^2$, . . . , 410*b*$^n$, and other horizontal row beamformers (not illustrated) of beamformer group 412, which lie between horizontal row beamformers 412*a* and 412*m*, have output ports coupled to other vertical column beamformers, which in turn feed other elemental antennas and their phase shifters of other vertical subgroups.

Each horizontal row beamformer of group 412 of beamformers is fed from a subarray level phase shifter 312; for example, horizontal row beamformer 412*a* is fed by a subarray level phase shifter 312*a*, horizontal row beamformer 412*m* is fed by a subarray level phase shifter 312*m*, and those horizontal row beamformers (not illustrated) lying between horizontal row beamformers 412*a* and 412*m* are fed by other phase shifters (not illustrated) lying between phase shifters 312*a* and 312*m*. Subarray level phase shifters 312*a*, 312*m*, and the other such phase shifters lying therebetween, are fed from the output ports of a 1:Y vertical column beamformer 414$^1$. More specifically, phase shifter 312*a* is fed from the uppermost output port 414*a* of vertical column beamformer 414$^1$, and phase shifter 312*m* is fed from the lowermost output port 414*m* of vertical column beamformer 414$^m$. The common port of vertical column beamformer 414$^1$ is fed over a path 482$^1$ from an output port of a 1:Z horizontal beamformer 484*m*, the common input port of which is designated 486, and which represents the input port for the entire antenna array of FIG. 4. Other output ports of 1:Z horizontal row beamformer 484 are coupled to arrangements similar to that so far described in relation to FIG. 4.

In FIG. 4, the nearest vertical column of elemental antennas of the furthest subgroup is designated 1210, just as the nearest subgroup of antenna elements is designated 210, and the elements of the column are broken into vertically disposed subarrays. The uppermost subgroup is designated 1408*t*, and the lower ones are designated 1408*b*. Within the nearest column of elemental antennas 1210 of the furthest subgroup, the antenna elements 1210 are designated 1210*a*$^1$, 1210*b*$^1$, . . . , 1210*c*$^1$, . . . 1210*d*$^1$, 1210*e*$^1$, . . . 1210*f*$^1$. The next or second column of antenna elements has its upper element designated 1210*a*$^2$, while the two upper elements of the last, n$^{th}$ or most remote vertical column of the furthest subsection, are designated 1210*a*$^n$ and 1210*b*$^n$. Antenna elements 1210*a*$^1$, 1210*b*$^1$, . . . 1210*c*$^1$, . . . 1210*d*$^1$, 1210*e*$^1$, . . . 1210*f*$^1$ are associated with corresponding phase shifters 1212*a*$^1$, 1212*b*$^1$, . . . 1212*c*$^1$, . . . , 1212*d*$^1$, 1212*e*$^1$, . . . 1212*f*$^1$, respectively. Also, antenna elements 1210*a*$^2$, 1210*a*$^n$ and 1210*b*$^n$ are coupled to their respective phase shifters 1212*a*$^2$, 1212*a*$^n$ and 1212*b*$^n$.

The elemental antennas 1210*a*$^1$, 1210*b*$^1$, . . . , 1210*c*$^1$ of upper subgroup 1408*t* of FIG. 4, and their associated phase shifters 1212*a*$^1$, 1212*b*$^1$, . . . , 1212*c*$^1$, are fed by a 1:N vertical column beamformer 1410*a*$^1$. Additional 1:N vertical column beamformers 1410*a*$^2$ and 1410*a*$^n$ feed the vertical subarray including top elemental antenna 1210*a*$^2$ and its associated phase shifter 1212*a*$^2$*m*, vertical column beamformer 1410*a*$^n$ feeds the vertical subarray including top elemental antennas 1210*a*$^n$ and 1210*b*$^n$and their associated phase shifters 1212*a*$^n$ and 1212*b*$^n$, and other vertical column beamformers (not illustrated) lying between vertical column beamformers 1410*a*$^2$ and 1410*a*$^n$, feed other vertical column subgroups (not illustrated). Similarly, elemental antennas 1210*d*$^1$, 1210*e*$^1$, . . . , 1210*f*$^1$ of lower subgroup 1408*b* of FIG. 4, and their associated phase shifters 1212*d*$^1$, 1212*e*$^1$. . . , 1212*f*$^1$, are fed by a 1:N vertical column beamformer 1410*b*$^1$. Additional 1:N vertical column beamformers 1410*b*$^2$ and 1410*b*$^n$ feed other vertically disposed subarrays of elemental antennas and their associated phase shifters.

The vertical column beamformers 1410*a*$^1$, 1410*a*$^2$, . . . , 1410*a*$^n$, 1410*b*$^1$, 1410*b*$^2$, 1410*b*$^n$, of vertically disposed subgroups 1408*t* and 1408*b*, and of other corresponding vertically disposed subgroups, are fed by horizontal beamformers 1412. More particularly, each output port 1413*a*$^1$, 1413*a*$^2$, . . . 1413*a*$^n$ of a 1:M horizontal row beamformer 1412*a* is coupled to the input port of a corresponding one of vertical column beamformers 1410*a*$^1$, 1410*a*$^2$, . . . , 1410*a*$^n$, each output port 1413*b*$^1$, 1413*b*$^2$, . . . 1413*b*$^n$ of a 1:M horizontal row beamformer 1412*m* is coupled to the input port of a corresponding one of vertical column beamformers 1410*b*$^1$, 1410*b*$^2$, . . . , 1410*b*$^n$, and other horizontal row beamformers (not illustrated) of beamformer group 1412, which lie between horizontal row beamformers 1412*a* and 1412*m*, have output ports coupled to other vertical column beamformers, which in turn feed other elemental antennas and their phase shifters of other vertical subgroups.

Each horizontal row beamformer of group 1412 of beamformers is fed from a subarray level phase shifter 1312; for example, horizontal row beamformer 1412*a* is fed by a subarray level phase shifter 1312*a*, horizontal row beamformer 1412*m* is fed by a subarray level phase shifter 1312*m*, and those horizontal row beamformers (not illustrated) lying between horizontal row beamformers 1412*a* and 1412*m* are fed by other phase shifters (not illustrated) lying between phase shifters 1312*a* and 1312*m*. Subarray level phase shifters 1312*a*, 1312*m*, and the other such phase shifters lying therebetween, are fed from the output ports of a 1:Y vertical column beamformer 414$^1$. More specifically, phase shifter 1312*a* is fed from the uppermost output port 1414*a* of vertical column beamformer 1414$^1$, and phase shifter 1312*m* is fed from the lowermost output port 1414*m* of vertical column beamformer 414$^m$. The common port of vertical column beamformer 414$^1$ is fed over a path 482$^1$ from an output port of 1:Z horizontal beamformer 484*m*. As mentioned above, the common input port 486 of horizontal beamformer 484*m* is the input port for the entire antenna array of FIG. 4. Other output ports of 1:Z horizontal row beamformer 484 are coupled to arrangements similar to those so far described in relation to FIG. 4.

As mentioned, vertical column beamformers 414$^1$ and 1414 are fed from corresponding output ports 482$^1$ and 482$^4$ of horizontal row beamformer 484 of FIG. 4. Similarly, vertical column beamformers 414$^2$ and 414$^3$, and all the other vertical column beamformers lying between column beamformers 414$^3$ and 1414, are fed, over paths designated 482$^2$, . . . by the outputs of horizontal row beamformer 484.

The size of each subarray is selected to achieve a beam width that will maintain an instantaneous bandwidth which is greater than, or at least equal to, the hopping bandwidth of the signal which is transmitted. The elemental phase shifters 212, 1212 set the nominal beam direction, and the correction phase is simply a positive or negative delta or change of the phase settings of the subarray phase shifters 312, 1312. The elemental phase shifters are set to produce a beam in the desired direction at one frequency within a subset of frequency hops, for example at the center frequency of a set of five frequencies, and at the other four frequencies, the elemental phase shifters are left at the original setting, and only the correction phase shifters are reset at each frequency hop to maintain the beam in the desired direction.

Figure 1:
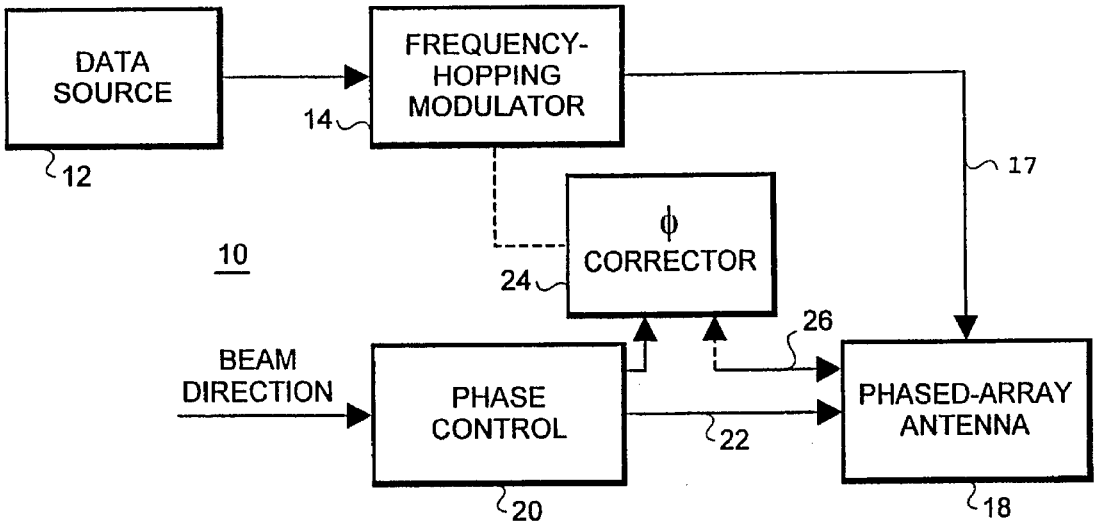
FIG. 1 is a simplified block diagram of communication system including a frequency-hopping transmitter and a phased-array antenna.
Figure 5:
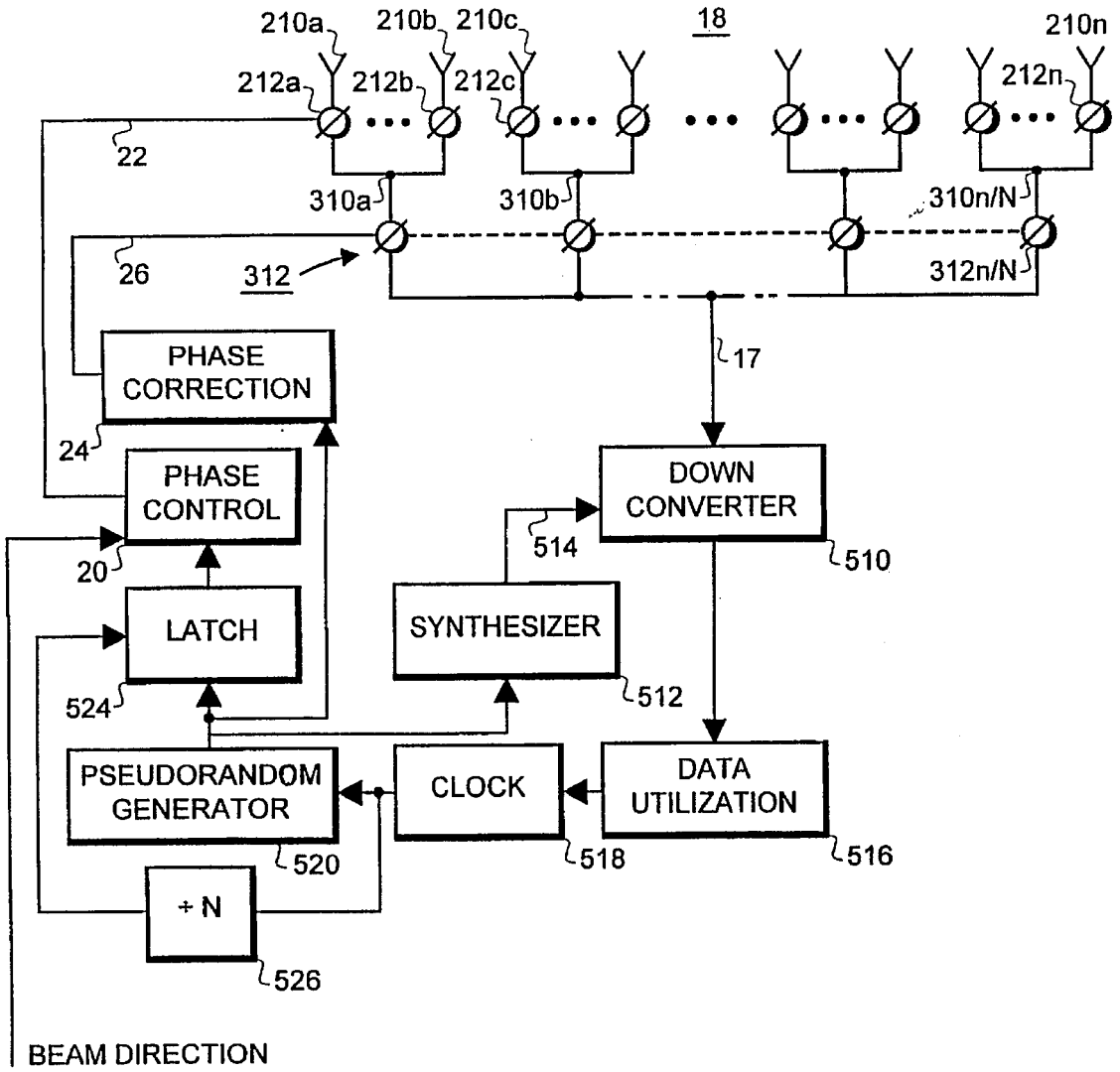
FIG. 5 illustrates a receiving system according to an aspect of the invention

FIG. 5 illustrates a receiving system according to an aspect of the invention, in which elements corresponding to those of FIGS. 1 and 3 are designated by like reference numerals. In FIG. 5, the RF signals appearing on path 17 are applied to a downconverter 510, which downconverts the RF to an intermediate frequency (IF) or to baseband, with the aid of a reference frequency from a frequency synthesizer 512. The frequency of synthesizer 512 may be established, in known fashion, by a known coding device, such as a logical pseudorandom signal generator 520 in conjunction with a clock signal from a generator 518 controlled by the received signal. The downconverted data or recovery signal is then available from downconverter 510 for use by utilizing apparatus 518.

The nominal beam direction of the array of elemental antennas 210*a*–210*n* is established by the settings of elemental phase shifters 212*a*–212*n* established by phase control block 20. The elemental phase shifters 212*a*–212*n* are updated by the pseudorandom signal from generator 520, latched by a latch 524 every 1/N clock cycles by a divider 526.

The array according to the invention is very advantageous in reducing the control requirements of a phased-array antenna in a frequency-hopping environment. For example, a 4096-element array with 4096 elemental phase-shifters could be subdivided into 64 subarrays, with each subarray controlled by a correction or further phase-shifter. In this arrangement, only 64, rather than 4096, phase shifters must be updated at each hopping cycle. In such an arrangement, the elemental phase shifters would only have to be updated to correct the beam direction in response to relative motion between the antenna and the target. Even for airborne antennas, this is a relatively slow correction, easily accommodated.

Other embodiments of the invention will be apparent to those skilled in the art. While the arrangement of FIG. 1 illustrates application of the modulated signal from modulator 14 directly to phased-array antenna 18, a power amplifier could be used to raise the power of the modulated signal, thereby reducing the need for amplification.

What is claimed is:

1. An array antenna for use with a frequency-hopping signal, said array antenna comprising:

an array of antenna elements, each for transducing electromagnetic signals between space and a corresponding RF port;

phase-shifting means coupled to the RF port of each of said antenna elements of said array of antenna elements, for phase-shifting said signals under the control of beam direction control signals;

beam direction control signal generating means coupled to said phase-shifting means, for controlling said phase shift of each of said phase-shifting means in a manner selected for forming at least one beam in a selected direction;

one of a source and sink of frequency-hopping RF signals for one of generating or receiving said frequency-hopping signals, respectively, and for generating frequency-indicative control signals representative of the instantaneous frequency of said frequency-hopping signals;

coupling means coupled to said phase-shifting means and to said one of said source and sink, for coupling said frequency-hopping signals between said phase-shifting means and said one of said source and sink, whereby a corresponding one of a transmit and receive beam is generated by said array, but changes in frequency of said frequency-hopping RF signals cause deviations of said beam from said selected direction; said coupling means further comprising (a) grouping means coupled to predetermined groups of said phase-shifting means, for grouping said phase-shifting means and their associated antenna elements into plural subgroups, each including a subgroup feed port and (b) additional phase shifting means coupled to each of said subgroup feed ports, for controllably shifting the phase of said RF signals applied to said antenna elements of each of said subgroups; and antenna beam correction control means coupled to said additional phase-shifting means and to said one of said source and sink, for generating beam direction correction signals in response to said frequency-indicative control signals, for generating a group phase shift of said RF signals which tends to offset said deviations of said beam from said desired direction.

2. A method for operating an array antenna in conjunction a frequency-hopping signal, said array antenna including (a) an array of antenna elements, each for transducing electromagnetic signals between space and a corresponding RF port, (b) elemental phase-shifting means coupled to the RF port of each of said antenna elements of said array of antenna elements, for phase-shifting said signals under the control of beam direction control signals, (c) one of a source and sink of frequency-hopping RF signals for one of generating or receiving said frequency-hopping signals, respectively, and for generating frequency-indicative control signals representative of the instantaneous frequency of said frequency-hopping signals (d) coupling means coupled to said elemental phase-shifting means and to said one of said source and sink, for coupling said frequency-hopping signals between said phase-shifting means and said one of said source and sink, said coupling means further comprising (a) grouping means coupled to predetermined groups of said elemental phase-shifting means, for grouping said elemental phase-shifting means and their associated antenna elements into plural subgroups, each including a subgroup feed port and (b) additional phase shifting means coupled to each of said subgroup feed ports, for controllably shifting the phase of said RF signals applied to said antenna elements of each of said subgroups, said method comprising the steps of:

generating elemental beam direction control signals for said elemental phase-shifting means, for controlling each of said phase-shifting means for forming at least one beam in a selected direction at a frequency within a current set of hopping frequencies, whereby a corresponding one of a transmit and receive beam is generated by said array, but changes in frequency of said frequency-hopping RF signals within said current set of hopping frequencies cause deviations of said beam from said selected direction; and generating group beam correction control signals for said additional phase-shifting means, for generating, at each of said frequencies within said current set of hopping frequencies, a group beam direction control signal, for generating a group phase shift of said RF signals which tends to offset said deviations of said beam from said selected direction.

* * * * *